US007096573B2

(12) United States Patent
Holliday

(10) Patent No.: US 7,096,573 B2
(45) **Date of Patent: *Aug. 29, 2006**

(54) COMPRESSION HAND TOOL FOR CABLE

(76) Inventor: Randall A. Holliday, 4360 Augusta Dr., Broomfield, CO (US) 80020

( * ) Notice: Subject to any disclaimer, the term of this patent is extended or adjusted under 35 U.S.C. 154(b) by 0 days.

This patent is subject to a terminal disclaimer.

(21) Appl. No.: 10/794,249

(22) Filed: Mar. 5, 2004

(65) Prior Publication Data

US 2004/0163238 A1 Aug. 26, 2004

Related U.S. Application Data

(63) Continuation-in-part of application No. 09/356,859, filed on Jul. 19, 1999, now Pat. No. 6,293,004, and a continuation of application No. 09/960,566, filed on Sep. 20, 2001, now Pat. No. 6,708,396.

(51) Int. Cl.
*H01R 43/42* (2006.01)

(52) U.S. Cl. ..... 29/751; 29/753; 29/755; 29/758; 29/761; 29/33 M; 72/409.14

(58) Field of Classification Search ..... 29/751, 29/753, 760, 863, 268, 33 M; 72/409.14, 72/409.13, 410–412; 7/107
See application file for complete search history.

(56) References Cited

U.S. PATENT DOCUMENTS

| | | | | |
|---|---|---|---|---|
| 5,435,167 | A * | 7/1995 | Holliday et al. | 72/409.14 |
| 5,647,119 | A * | 7/1997 | Bourbeau et al. | 29/751 |
| 5,934,137 | A * | 8/1999 | Tarpill | 72/409.14 |
| 6,293,004 | B1 * | 9/2001 | Holliday | 29/751 |
| 6,708,396 | B1 * | 3/2004 | Holliday | 29/751 |

* cited by examiner

*Primary Examiner*—Minh Trinh
(74) *Attorney, Agent, or Firm*—John E. Reilly

(57) ABSTRACT

A hand-held tool for terminating connectors onto a coaxial cable has an elongated body and an end stop and plunger on the body, the plunger being controlled by a lever arm which will axially advance the plunger toward and away from the end stop to radially compress a portion of the connector into firm crimping engagement with the end of the coaxial cable. To accommodate different lengths of connectors, a receiver is mounted on the plunger for insertion of different length adapter tips to vary the axial spacing between the receiver and the end stop according to the length of connector being terminated; and in still another form the body may include a hinged adapter adjacent to the end stop to vary the effective distance between the end stop and plunger according to the length of fitting being terminated.

7 Claims, 6 Drawing Sheets

COMPRESSION HAND TOOL FOR CABLE

CROSS-REFERENCE TO RELATED APPLICATIONS

This application is a continuation-in-part of patent application Ser. No. 09/356,859, filed 19 Jul., 1999, now U.S. Pat. No. 6,293,004, granted 25 Sep. 2001, for LENGTHWISE COMPLIANT CRIMPING TOOL by Randall A. Holliday and a continuation of application Ser. No. 09/960,566, filed 20 Sep. 2001 now U.S. Pat No. 6,708,396 for UNIVERSAL CRIMPING TOOL by Randall A. Holliday, both incorporated by reference herein.

BACKGROUND AND FIELD

This application relates to crimping tools, and more particularly relates to a novel and improved hand-held crimping tool for crimping different types and lengths of connectors onto coaxial cables in a simplified and highly effective manner. In the hereinbefore referred to U.S. Letters Patent for LENGTHWISE COMPLIANT CRIMPING TOOL, a hand-held crimping tool is automatically adjustable to compensate for slight differences in length of coaxial cable fittings, such as, differences resulting from manufacturing tolerances, dirt or wear. In that tool, the coaxial cable fitting is inserted into a seat on a die portion so that the cable end is in facing relation to a plunger. The plunger has a chuck and spring-loaded biasing member at one end in facing relation to the die portion, and a crimpable connector is loosely assembled on the cable end between the biasing member and seat so that when the plunger is advanced toward the seat it will force a preassembled crimping ring on the connector to radially compress the connector into sealed engagement with the cable end. Thus, the spring-loaded biasing member will absorb any continued movement of the chuck after the crimping ring contracts the connector to its maximum limit onto the cable end and automatically compensate for slight differences in effective length of the connector end.

Previously, in U.S. Pat. No. 5,435,167 for CABLE END COMPRESSOR, assigned to the assignee of this invention, a hand-held tool is disclosed for terminating different length and type cable end connectors and specifically adapted for terminating RG59 and RG6 coaxial cables. This tool is characterized by utilizing a hinged spacer which can be pivoted into position in front of an end stop on the tool to alter the effective length or distance between the spacer and plunger. For example, the spacer has a thickness equal to the difference in length between the RG59 connector and the RG6 connector, although a different type of compression member is employed than in the LENGTHWISE COMPLIANT CRIMPING TOOL. Accordingly, in a modified form of invention, it is proposed to incorporate a hinged spacer as hereinbefore described in combination with different extension tips in terminating different length coaxial cable connectors.

There is a continuing need for a crimping tool which is more versatile and capable of handling different sizes and lengths of connectors including but not limited to the RG59, RG6, RCA, BNA and IEC connectors. In addition, it is highly desirable to simplify the crimping operation by applying an axially directed force to a sleeve portion of the connector which receives the cable end in such a way as to impart radial compression to the connector into crimping engagement with the cable end.

SUMMARY

It is therefore an object to provide for a novel and improved universal crimping tool and more specifically a hand-held crimping tool for terminating a connector onto a coaxial cable in a simplified, highly efficient manner.

It is a further object to provide for a novel and improved crimping tool which is conformable for crimping different sizes and types of connectors onto the end of a coaxial cable and which is lengthwise compliant to compensate for slight differences in length of fittings owing to differences in tolerance and wear as well as to more substantial differences in length and size of different types of fittings.

Another feature is to provide for a hand-held, universal crimping tool which automatically compensates for slight differences in length of the connector assembly and includes interchangeable adapters to compensate for more substantial differences in length and size of cable end connectors or fittings.

In accordance with one object of this invention, a tool has been devised for terminating different lengths of connectors onto a cable end wherein an elongated body has an end stop and plunger in aligned, axially spaced relation to one another and a force-applying member is provided for axially advancing said plunger toward and away from the end stop whereby to radially compress a portion of the connector into crimping engagement with the cable end. The tool is comprised of a receiver including means resiliently mounting the receiver on the plunger, and adapter means between the plunger and end stop are operable to adjust the axial spacing between the receiver and end stop according to the length of connector being terminated onto the cable end. In a modified form, the body may include a hinged adapter at the end stop to alter the effective distance between the end stop and plunger according to the length of fitting to be terminated. As in the preferred form, a spring-loaded member on the plunger includes a receiver which is yieldable in an axial direction in response to advancement of the fitting into engagement with the end stop, and a lever arm is mounted on the body to axially advance the plunger toward and away from the end stop. Preferably, the receiver includes circumferentially spaced gripping portions either to releasably engage a collar at the end of the fitting or to engage one of a plurality of tip extenders for different length fittings. Each tip extender includes a slotted cylindrical projection to receive the conductor pin projecting beyond the deformable sleeve of the cable and an abutment for the end of the collar on the fitting.

There has been outlined the more important features in order that the detailed description thereof that follows may be better understood, and in order that the present contribution to the art may be better appreciated. There are, of course, additional features that will be described hereinafter and which will form the subject matter of the claims appended hereto. In this respect, it is to be understood that embodiments are not limited in their application to the details of construction and to the arrangements of the components set forth in the following description and is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes described herein. It is important, therefore, that the claims be regarded as including such equivalent constructions insofar as they do not depart from the spirit and scope thereof.

DETAILED DESCRIPTION OF ONE EMBODIMENT

Figure 1:
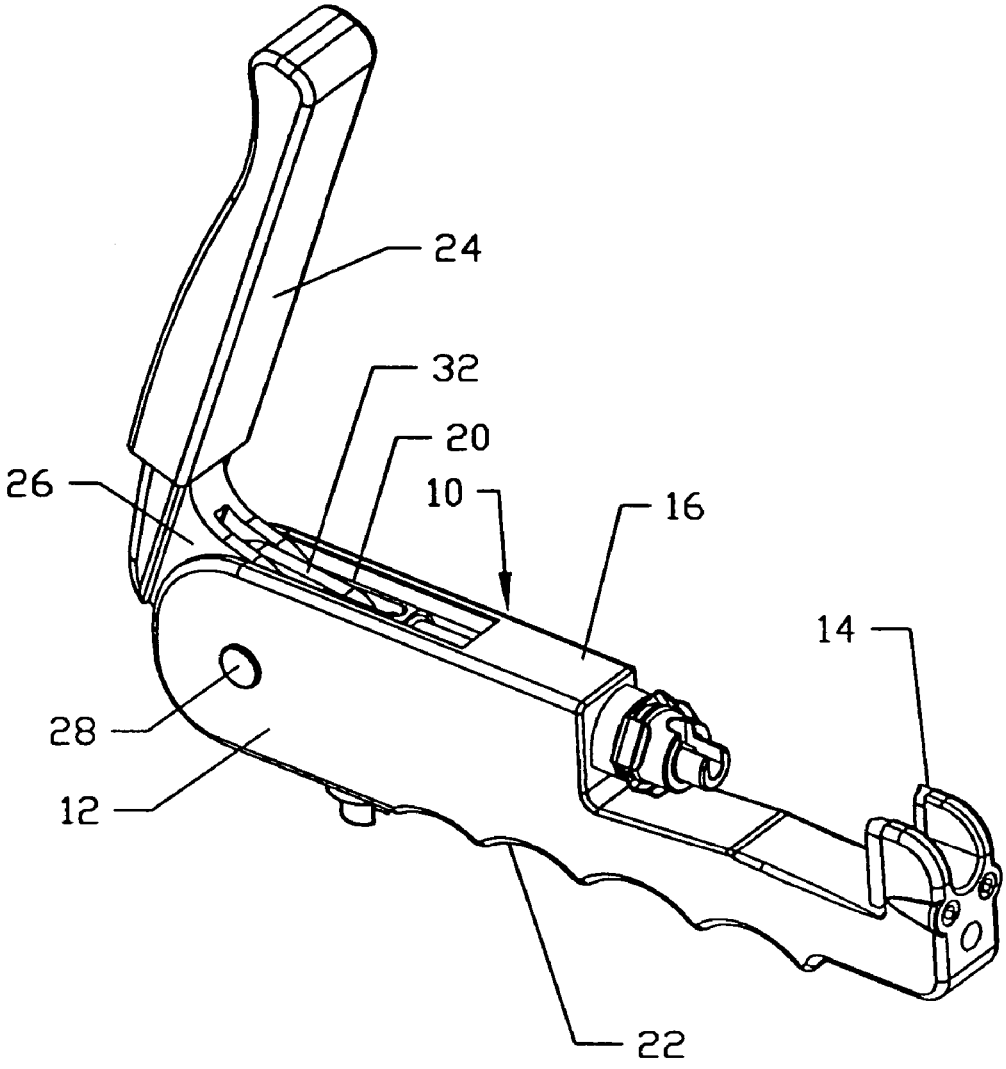
FIG. 1 is a perspective view of one embodiment of crimping tool.

Referring in more detail to the drawings, FIGS. 1 to 7 illustrate one embodiment of a tool 10 which is made up of an elongated body 12 having a yoke 14 at one end to define an end stop and is in facing relation to a raised portion 16 of the body having an axially extending, plunger-receiving bore 18 which communicates with a channel-shaped opening or recess 20. The undersurface of the body 10 is scalloped as at 22 to define gripping portions for the fingers in manually grasping the tool. A lever arm 24 has a right angle pivotal end portion 26 which is mounted on a pivot shaft 28 adjacent to one end of the recessed portion 20 opposite to the end stop 14. The pivotal end 26 is offset at substantially right angles to the length of the lever arm 24 and is provided with a groove 30 for insertion of one end of a floating link 32. The link 32 is pivotally attached as at 31 within the grooved portion 30 and at its opposite end is pivotally attached as at 33 to a bifurcated end 34 of plunger 36. The lever arm 24 tapers away from the pivotal end 26 and terminates in a relatively narrow free end portion 38.

A cross pin or rivet 40 is inserted into the bifurcated end portion 34 and a transverse bore at the end of the plunger 36 so as to anchor the plunger to the bifurcated end 34.

The plunger 36 has an outer sleeve 42, the latter terminating in a flanged end 44 adjacent to the rivet pin 40 and at its opposite end bears against a series of spring elements 46 which are retained in a generally cup-shaped housing 48 on the end of the plunger. The spring elements 46 are illustrated as a series of stacked annular disks or washers canted in opposite directions and mounted under compression between the end wall of the housing 48 and end of the liner 42. As shown, the disks are arranged in a "series stack", but may be arranged in a "parallel stack" or nested relation to one another, or in a "parallel/series stack" depending on the amount of flexion desired for a given load. Other types of spring elements that may be employed are illustrated in my hereinbefore referred to patent application Ser. No. 356,859 for LENGTHWISE COMPLIANT CRIMPING TOOL and incorporated by reference herein. The plunger assembly is slidable through a bushing 50 which surrounds the bore 18 in the raised portion 16 of the body 10.

The end of the plunger 36 which carries the spring elements 46 and housing 48 is provided with a bore 52 for insertion of shaft 58 on base plate 51 of a tip extender 60, and a receiver 54 includes an annular base portion 55 which is sandwiched between the tip extender and housing 48. A plurality of circumferentially spaced tabs 56 extend from the base 55 toward the end stop 14, each of the tabs 56 being of generally concavo-convex configuration, and of a thin resilient metal or plastic material. In this way, the tabs 56 are capable of flexing at least to a limited extent about their connection to the base 55 in retaining the end of a connector A in a manner to be hereinafter described.

Figure 2:
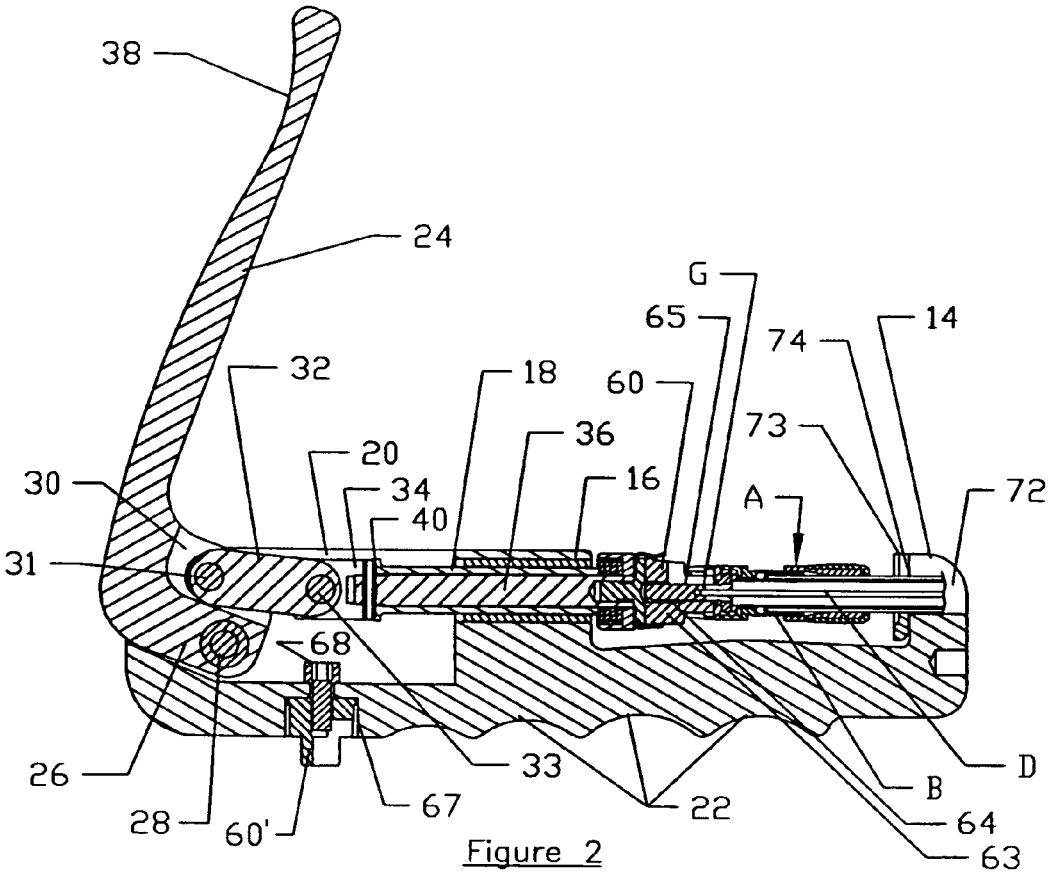
FIG. 2 is a longitudinal sectional view of the of crimping tool of FIG. 1 shown in the expanded position with an F-connector assembly in position to be crimped.
Figure 3:
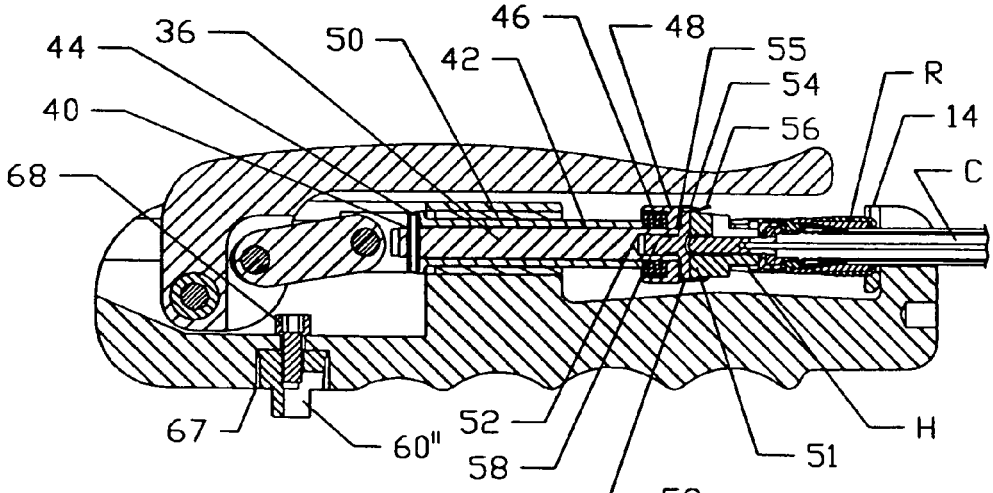
FIG. 3 is a sectional view of the tool and connector assembly illustrated in FIG. 3 at the completion of the crimping operation.

In order to accommodate different length standard end connectors, such as, the F-connector A in FIGS. 2 and 3, adapter means in the form of the tip extender 60 is releasably inserted into the receiver 54. The extender 60 also includes a generally cylindrical body 63 having a bore 64 and an upwardly facing slot or channel 65 in a reduced end or nose portion 66 of the body 63 communicating with the bore 64. In accordance with conventional practice, the F-connector A intended for retail use is shorter than the commercial F-connector. For this purpose, a substitute adapter 60' which has a longer nose 65 than the extender 60 is inserted into a recess 67 and threadedly connected to a screw 68 which projects into the recess from the cavity 20. In this manner, the extender 60' is readily accessible and may be substituted for the extender 60 so as to compensate for the shorter length of F-connector. The end stop 14 includes an upwardly facing, generally U-shaped channel 72, and a seat 73 having a beveled end surface and of bifurcated or generally U-shaped configuration mounted in facing relation to the extender 60 and receiver 54. The coaxial cable C is then placed in the channel 72 of the end stop 14 during the crimping operation so as to be in alignment with the plunger 36.

In use, the cable C is prepared according to connector requirements to provide the proper braid exposure at B and length of center conductor D. The connector A is loosely assembled onto the cable with the aid of a starter guide G which is mounted on the end of the center conductor D and extends forwardly through the central bore 64. The tool 10 is illustrated in the open position in FIG. 1, and FIG. 2 illustratese the connector A loosely assembled onto the cable C between the extender 60 and the seat 73. The ferrule H, which is designated in FIG. 5, on the end of the connector is guided over the slotted end of the extender 60 with the aid of the guide G and the cable C placed in the slot 62 of the end stop 14. The body 10 is grasped in one hand with the fingers encircling the scalloped portions 22 and, with the other hand, the lever arm 24 is pressed toward the closed position against the body 10 thereby causing the plunger 36 to slide toward the end stop 14 as shown in FIG. 3. Under continued advancement, the crimping ring R will become firmly positioned in the seat 73 and may slidably advance toward the extender 60 thereby causing the sleeve portions S1 and S2 of the connector assembly to be radially compressed into firm crimping engagement with the cable.

Figure 4:
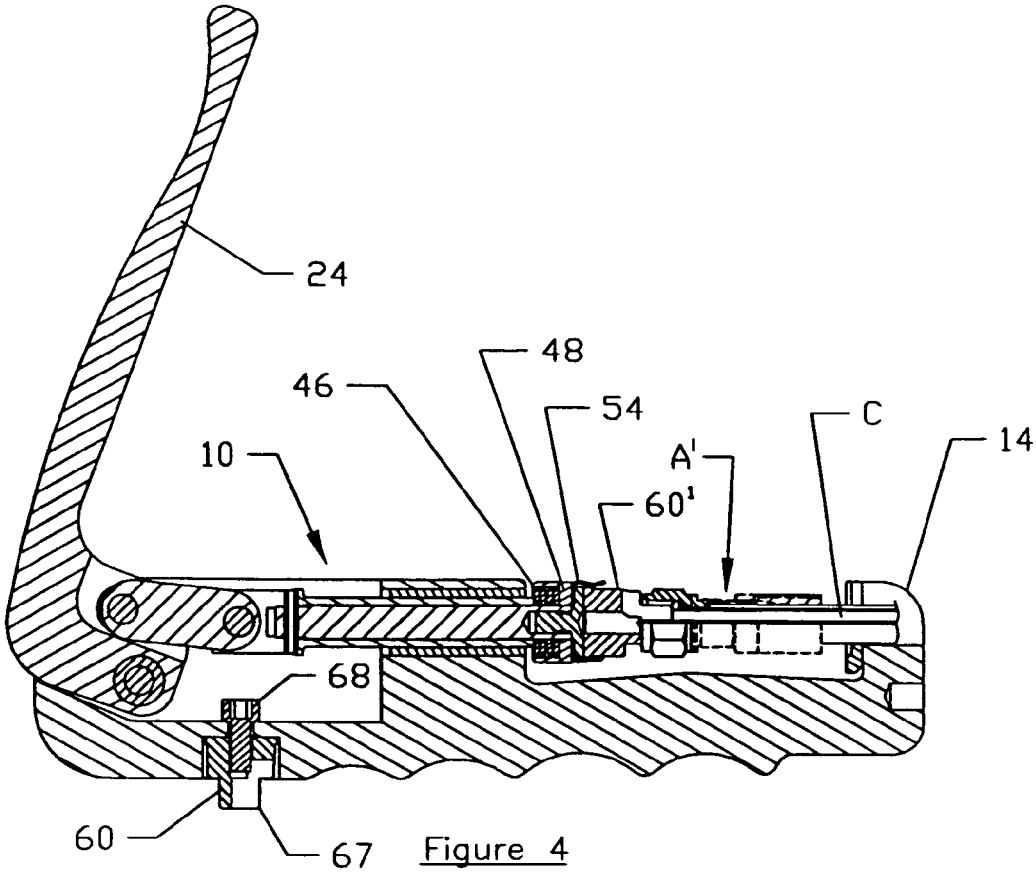
FIG. 4 is another sectional view of a preferred form of crimping tool with an RCA assembly in position to be crimped.
Figure 5:
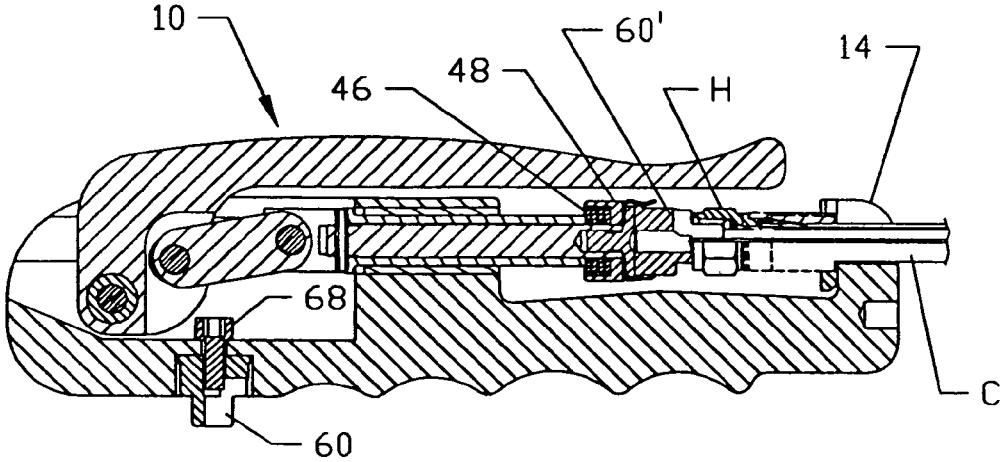
FIG. 5 is a sectional view of the tool and connector assembly illustrated in FIG. 5 at the completion of the crimping operation.

FIGS. 4 and 5 illustrate the application of the tool 10 for an RCA connector designated at A' and which contains the same make-up of elements as described with reference to the connector A in FIGS. 2 and 3 but is shorter. As in FIGS. 2 and 3, the cable C is inserted into the connector A' and placed in the end stop 14. However, the cable C is aligned with the plunger without the aid of the starter guide G. The ferrule H is aligned axially with respect to the end of the cable C by advancing the ferrule over the nose 65 of the extender 60 and moving the end of the cable C against the end of the nose 65 with the inner conductor pin, not shown, projecting into the channel 66 of the extender 60. Again, as the lever arm or handle 24 is closed against the body 12 of the tool 10, the plunger 36 is advanced toward the yoke or end stop 14 to axially advance the crimping ring R over the sleeves S1 and S2 in radially crimping the connector F' onto the cable C.

Figure 6:
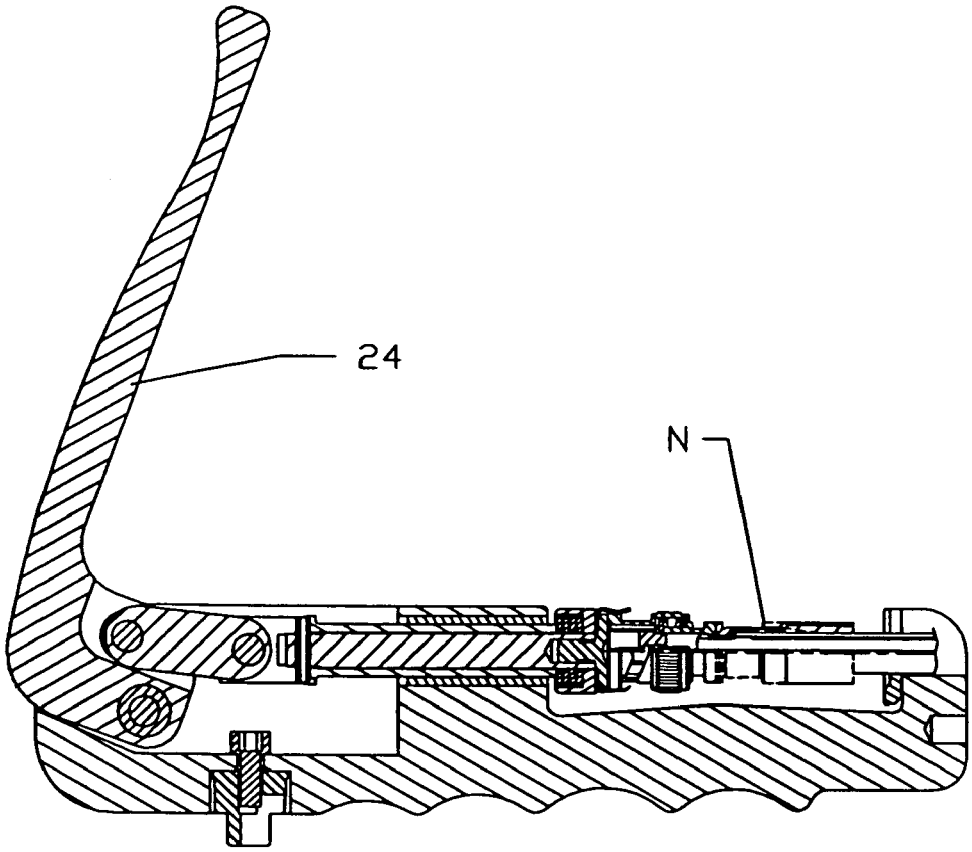
FIG. 6 is another longitudinal sectional view of the of tool of FIG. 1 shown in the open or expanded position for a BNC connector.
Figure 7:
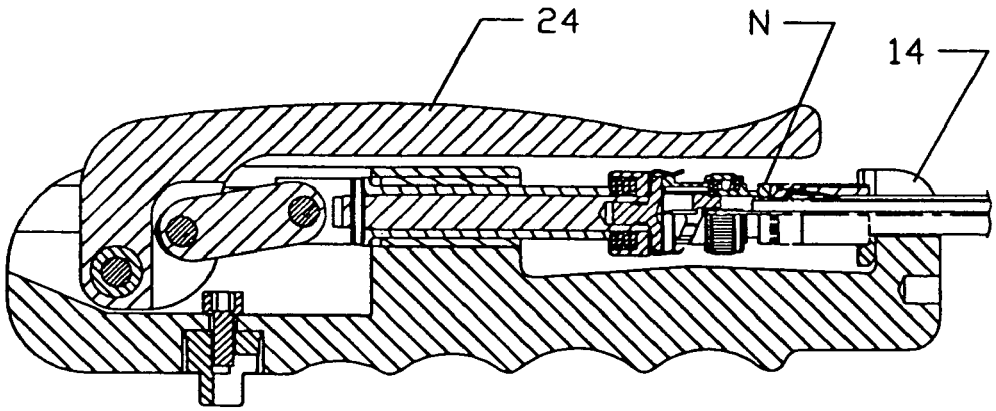
FIG. 7 is a sectional view of the tool illustrated in FIG. 6 at the end of the crimping operation.
Figure 10:
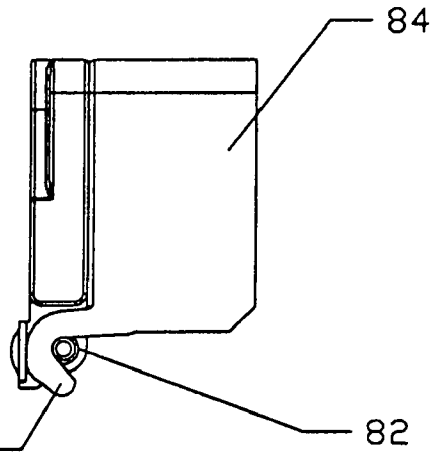
FIG. 10 is a side view in detail of the adapter shown in FIGS. 8 and 9.
Figure 9:
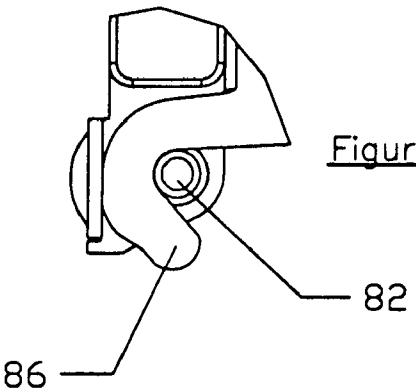
FIG. 9 is a fragmentary view in detail of the hinged portion of the adapter.
Figure 8:
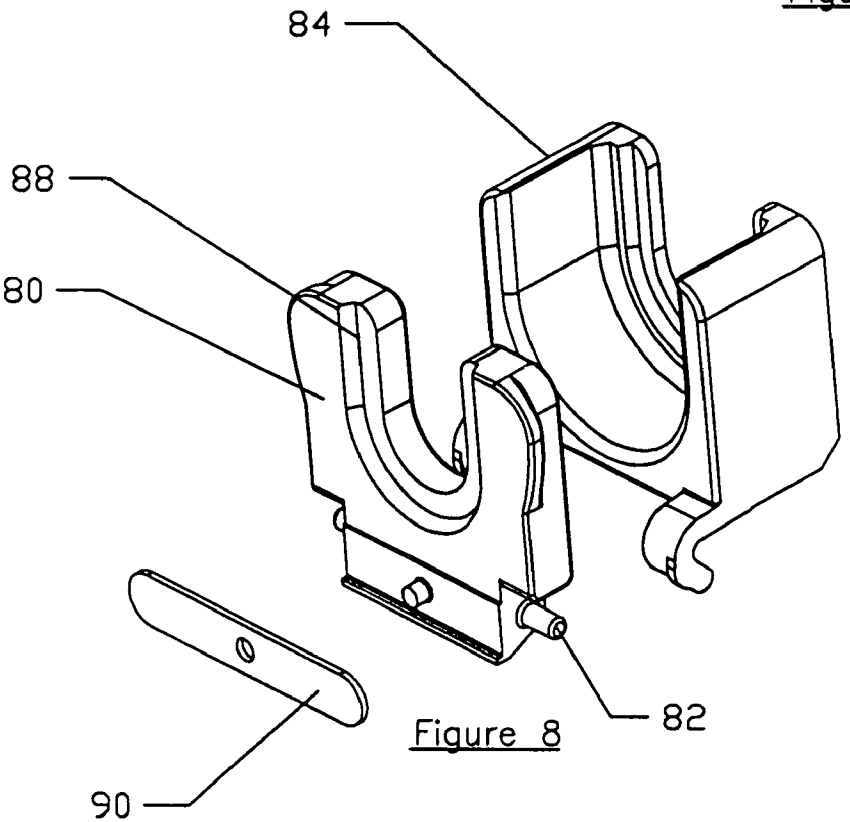
FIG. 8 is an exploded view of a modified form of adapter for the one embodiment.
Figure 11:
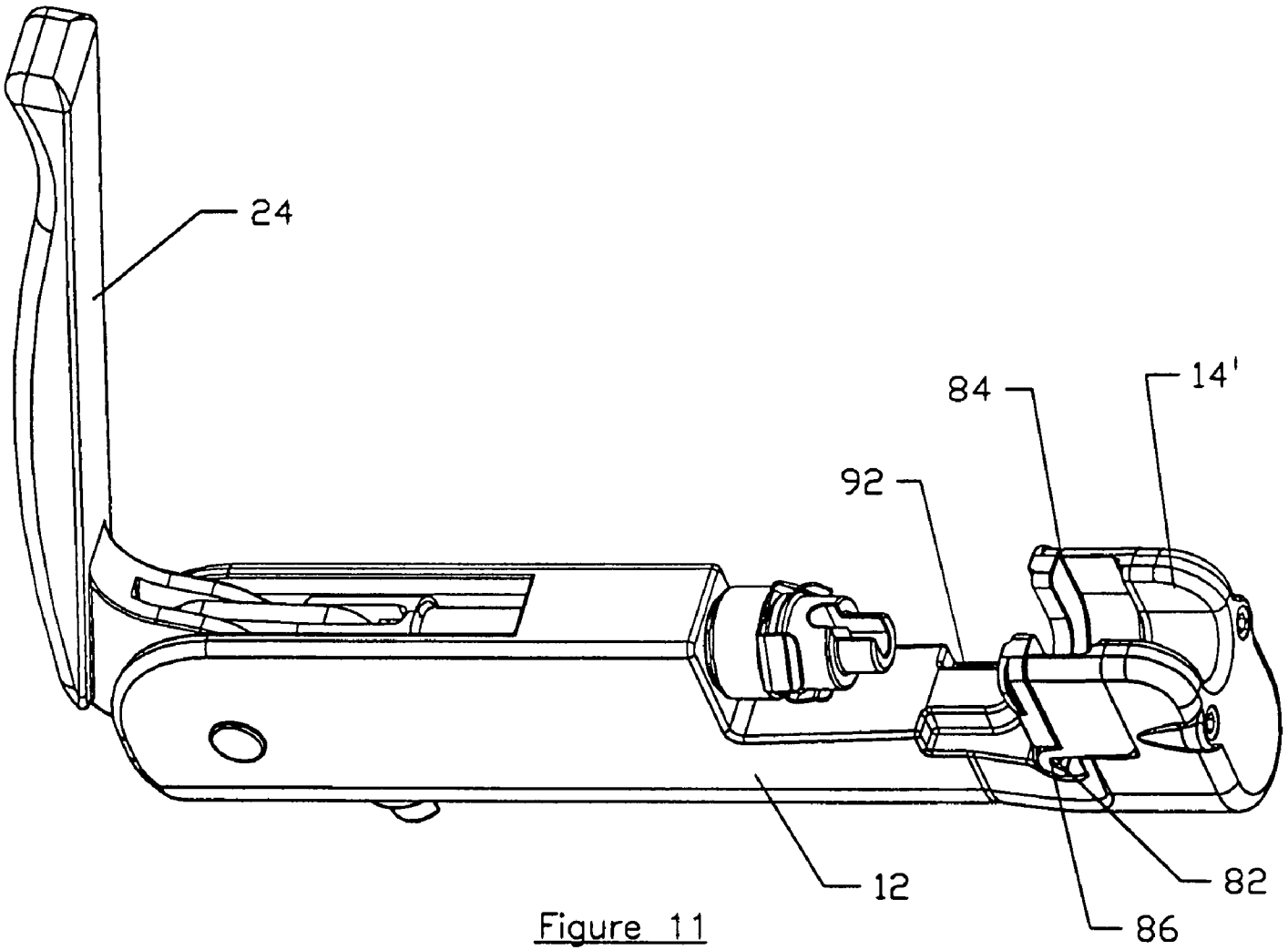
FIG. 11 is a perspective view of the modified form of adapter shown in FIGS. 8 to 10.

FIGS. 6 and 7 illustrate use of the tool 10 in crimping shorter connectors than the F series and RCA, such as, a BNA type of connector designated at N onto a cable C without the use of an extender 60. Instead, the leading end of the connector N is inserted directly into the receiver 54 until it abuts the base 55. As the handle 24 is closed down against the body, once again a crimping ring R on the connector N will be axially advanced and radially compress the sleeves S1 and S2 into crimping engagement with the cable C.

DETAILED DESCRIPTION OF MODIFIED EMBODIMENTS

FIGS. 8 to 11 illustrate a modified form for use with shorter connectors in which a flip-up adapter 80 is hinged at 82 onto a modified form of end stop 84. Like elements to those of FIGS. 1 to 7 are correspondingly enumerated. The end stop 84 is affixed at the end of the body 12 so as to form a continuation of the channel-shaped end stop 14'. A pair of return portions 86 extend from the lower end of the attachment 84 and are reverse-curved downwardly to receive hinge pins 82 at the lower edge of the adapter 80. The adapter 80 is also generally channel-shaped and includes a beveled end surface 88 which forms a seat for the end of the crimping ring R in the process of terminating the connector onto the cable C. An oblong spring plate 90 is affixed to the lower end of the hinge which bears against the portions 86 and exerts increasing pressure on the portions 86 as the adapter 80' is raised into a vertical position. For shorter connectors, the flip-up adapter 80 is pivoted upwardly into the position illustrated in FIG. 11 to receive the end of the crimping ring as described. However, when the tool is used with longer connectors, the flip-up adapter is hinged or pivoted downwardly against spring pressure to rest in the recessed area 92 in the body; or if desired the tip 60 can be removed. Accordingly, the adapter 80 may be used alone or in combination with one of the tips 60 thereby obviating the need for multiple crimping tools for terminating different length connectors.

It is therefore to be understood that the above and other modifications and changes may be made to the preferred and alternate embodiments described herein without departing from the spirit and scope of the invention and reasonable equivalents thereof.

I claim:

1. In a hand-held crimping tool for terminating different lengths of connectors onto an end of a coaxial cable wherein an elongated body has an end stop and plunger in aligned, axially spaced relation to one another, and force-applying means are provided for axially advancing said plunger toward and away from said end stop whereby to radially compress a portion of said connector into crimping engagement with said cable end, the improvement comprising:

a receiver having spring-like tabs in circumferentially spaced relation to one another and adapter means having a plurality of tips interchangeably mounted on said receiver to adjust the axial spacing between said receiver and said end stop according to the length of connector being terminated onto said cable end.

2. In a tool according to claim 1 wherein said circumferentially spaced tabs are provided for yieldingly receiving an end of said connector or one of said tips.

3. In a tool according to claim 2 wherein each of said tips is of a different length according to the length of said connector being terminated.

4. In a tool according to claim 1 wherein said adapter means includes an end plate mounted in hinged relation to said end stop for movement between an upright position in front of said end stop and a horizontal out-of-the-way position whereby to adjust the axial spacing between said receiver and said end stop.

5. In a tool according to claim 4 wherein said end stop and said end plate have aligned generally channel-shaped portions for insertion of said cable end therein.

6. In a tool according to claim 3 wherein each of said tips includes a first portion movable into seating engagement with said receiver and a second nose portion provided with a channel-shaped slot therein.

7. In a tool according to claim 1 including a recessed portion in said body for releasably securing one of said tips when another of said tips is mounted in said receiver.

* * * * *